US007083139B2

(12) United States Patent
Broekaert

(10) Patent No.: US 7,083,139 B2
(45) Date of Patent: Aug. 1, 2006

(54) METHOD FOR GUIDING A ROCKET

(75) Inventor: Michel Broekaert, L'Etang la Ville (FR)

(73) Assignee: Sagem SA (FR)

( * ) Notice: Subject to any disclaimer, the term of this patent is extended or adjusted under 35 U.S.C. 154(b) by 0 days.

(21) Appl. No.: 10/490,951

(22) PCT Filed: Sep. 23, 2002

(86) PCT No.: PCT/FR02/03240

§ 371 (c)(1),
(2), (4) Date: Jul. 29, 2004

(87) PCT Pub. No.: WO03/027599

PCT Pub. Date: Apr. 3, 2003

(65) Prior Publication Data

US 2004/0245370 A1 Dec. 9, 2004

(30) Foreign Application Priority Data

Sep. 25, 2001 (FR) ..... 01 12330

(51) Int. Cl.
*F41G 7/00* (2006.01)

(52) U.S. Cl. ..... 244/3.11; 244/3.17

(58) Field of Classification Search ..... 244/195, 244/196, 3.17, 189, 190, 191, 3.11, 3.14, 244/3.15, 3.16, 3.19; 89/464, 36.18; 348/117, 348/113; 342/69

See application file for complete search history.

(56) References Cited

U.S. PATENT DOCUMENTS

| | | | | |
|---|---|---|---|---|
| 3,459,392 | A * | 8/1969 | Buynak et al. | 244/3.17 |
| 3,712,563 | A * | 1/1973 | Alpers | 244/3.17 |
| 3,794,272 | A * | 2/1974 | Hecker | 244/3.17 |
| 3,986,682 | A * | 10/1976 | Dryden | 244/3.17 |
| 4,881,270 | A * | 11/1989 | Knecht et al. | 382/191 |
| 5,072,396 | A * | 12/1991 | Fitzpatrick et al. | 701/217 |
| 5,785,275 | A * | 7/1998 | Hiebl | 244/3.17 |
| 5,785,281 | A * | 7/1998 | Peter et al. | 244/190 |
| 5,881,969 | A * | 3/1999 | Miller | 244/3.17 |
| 6,347,762 | B1 * | 2/2002 | Sims et al. | 244/3.17 |
| 6,491,253 | B1 * | 12/2002 | McIngvale | 244/3.11 |

FOREIGN PATENT DOCUMENTS

DE 33 34 729 A1 4/1985

* cited by examiner

*Primary Examiner*—Galen Barefoot
(74) *Attorney, Agent, or Firm*—Akerman Senterfitt

(57) ABSTRACT

Method for guiding a rocket (1) to a target, wherein, the rocket (1) being equipped with automatic guiding means with an image-formation device (10) and means for correction of the trajectory (11):

the target is acquired by a sighting device and its position is determined;

the sighting device and the rocket image-formation device (10) are brought into line;

the images of the rocket image-formation device (10) are stabilized;

a guiding law is produced;

the rocket (1) is launched; and the rocket is guided according to this law until the rocket itself acquires the target.

6 Claims, 4 Drawing Sheets

METHOD FOR GUIDING A ROCKET

The invention relates to guiding of rocks.

A rocket is a small, non-guided missile. It is often used in anti-tank combat and can be launched from a land vehicle, sea vessel or air craft, for example from an aircraft or a helicopter. However, the invention also applies to missiles, and when reference is made to "rockets" in the text, the term should be taken in its general meaning, and it should be considered that missiles are also covered.

The precision of a rocket is not very great. However, when fired from a helicopter, it is also affected by the wind from the blades which gives rise to deflection from the trajectory.

Before a rocket is launched, an operator firstly gets the target in his sighting device, identifies it, tracks it in order to determine its angular speed, then carries out range finding so as to determine its distance and finally to ascertain the position of the target in his range marker. By means of this data and a flight model of the craft, the firing computer produces a future target which takes the form of a reticule in the sighting device.

It will be remembered that many missiles are equipped with automatic guiding means, i.e. a distance gauge system, which, according to the result of the comparison between the images of the reference target and the images captured in flight by an image-formation device, makes it possible to activate rudders or directional fuses for correction of the trajectory.

The object of the present application is to perfect the precision of rockets, and for this purpose, it relates to a method for guiding a rocket to a target, wherein, the rocket being equipped with automatic guiding means with an image-formation device and means for correction of the trajectory:

the target is acquired by a sighting device and its position is determined;

the sighting device and the rocket image-formation device are brought into line;

the images of the rocket image-formation device are stabilised;

a guiding law is produced;

the rocket is launched; and the rocket is guided according to this law until the rocket itself acquires the target.

It will be noted that the two devices for sighting and image formation of the launcher and of the rocket can be brought into line quite simply, respectively firstly by bringing into line the axes of sighting and image pick-up, then by calculating the image of the sighting device of the launcher in the range marker of the image-formation device of the rocket.

It will also be noted that the stabilisation of the images of the image-formation device of the rocket makes it possible at least to eliminate the disadvantages of the launcher before launching, and thus to stabilise these images in the absolute landscape of the target.

In a particular embodiment of the method according to the invention, before launching, an initial guiding law is produced and the rocket is guided until it acquires the target according to this initial law.

However, preferably, before launching, an initial guiding law is produced, and after launching a continuously variable guiding law is produced for correction of the trajectory until the rocket acquires the target.

Also preferably, in order to bring into line the sighting device and the image-formation device of the rocket, electronic bringing into line is carried out according to which, on a land reference frame, filtering takes place of the images of the scene taken at the same instants by the two devices in a low-pass filter, in order to retain only the spatial low frequencies, and the equation of the optical flow between these respective pairs of images of the two devices is solved in order to determine the rotations and the variation of the ratio of the respective zoom parameters to which these images must be subjected in order to bring them into line with one another.

Again preferably, the images of the image-formation device of the rocket are stabilised in a land reference frame on the landscape, even though stabilisation by an inertia system is always possible.

In this case, in this land reference frame, it is advantageous to filter the images of the scene taken by the image-formation device, in a low-pass filter, in order to select only the spatial low frequencies and to solve the equation of the optical flow, in order to determine the rotations to which the images must be subjected so as to stabilise them on the preceding images.

The invention will be better understood by means of the following description, provided with reference to the attached drawing, in which.

Figure 1:
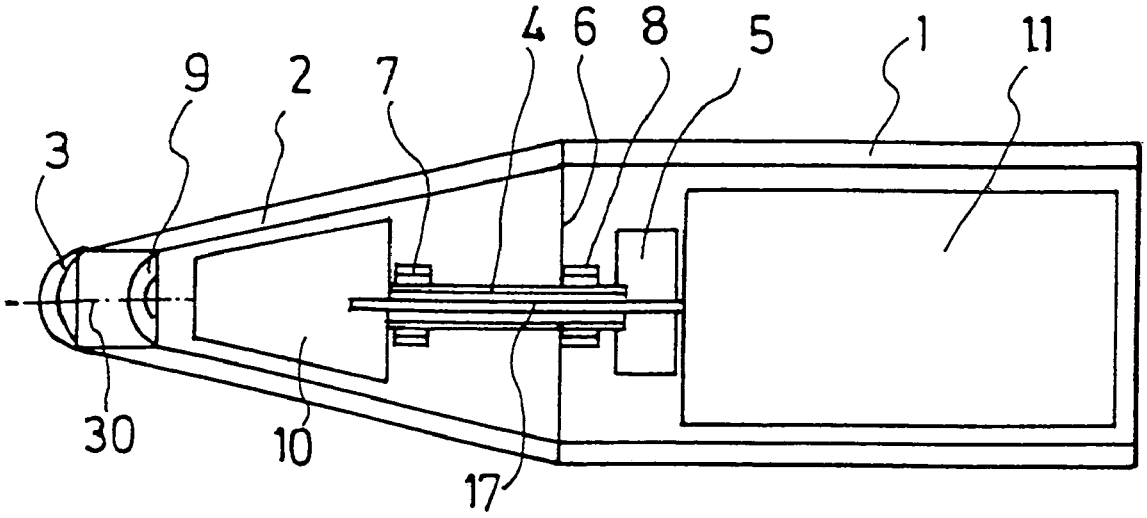
FIG. 1 is a view in schematic axial cross-section of a rocket equipped with automatic guiding means with an image-formation device and means for correction of the trajectory.

The rocket comprises a body 1, of which only the front part is shown, the rear part comprising the useful charge and the units for correction of the trajectory, which can be rudders or small directional fuses, and a nose 2 which is covered by a nose cone 3. The nose cone supports a first lens which acts as an aerodynamic port and focuses the image on the detector by means of the remainder of the optical unit described hereinafter. The nose cone supports a first lens which acts as an aerodynamic port and focuses the image on the detector by means of the remainder of the optical unit described hereinafter The rocket is a self-guiding spun rocket, partly in the nose and partly in the body, as will be described hereinafter, but of which the nose 2 and the body 1 are separated in rotation, the nose 2 supporting by means of a hollow shaft 4 an inertia wheel 5 which is disposed in the body 1 and creates differential spin between the nose 2 and the body 1, such that the nose 2 is rotated only very slowly, or not at all.

The hollow shaft 4 thus extends on both sides of the joining plane 6 between the nose 2 and the body 1, in roller bearings 7 and 8, respectively in one 2 and the other part 1 of the rocket.

The self-guiding unit of the rocket comprises, in the nose 2, behind the nose cap 3 and a fixed optical unit 9, an image-formation device 10, and in the body 1, equipment for correction of the trajectory, controlled by the device 10.

After launching, the equipment 11 assures comparison of the image taken by the image-formation device 10, with the large field and small field images stored of the scene, taken before launching, with the sighting device of the carrier which will be described hereinafter.

The image-formation device 10 comprises an image pick-up unit 13 with its conventional electronic proximity circuits 14, an analogue-digital converter 15 and an image transmission component 16. The device 10 is supplied from the body of the rocket, and via the hollow shaft 4, by a rechargeable battery 12. The image pick-up unit 13 can be a camera, or video or infra-red equipment. The transmission component 16 can be a laser diode or an LED (light-emitting diode). This component 16 can be disposed in the image-formation device 10, and thus, the images are transmitted via the hollow shaft 4 and the inertia wheel 5 by means of optical fibre 17 which extends along the axis of rolling 30 of the device. However, the image-transmission component 22 can be disposed in the inertia wheel 5, opposite a diode 24 which receives images transmitted, and thus the signal between the image-formation device 10 and the component 22 is transmitted by wires via the hollow shaft 4. The image-formation device is cooled by Peltier effect if necessary.

Figure 2:
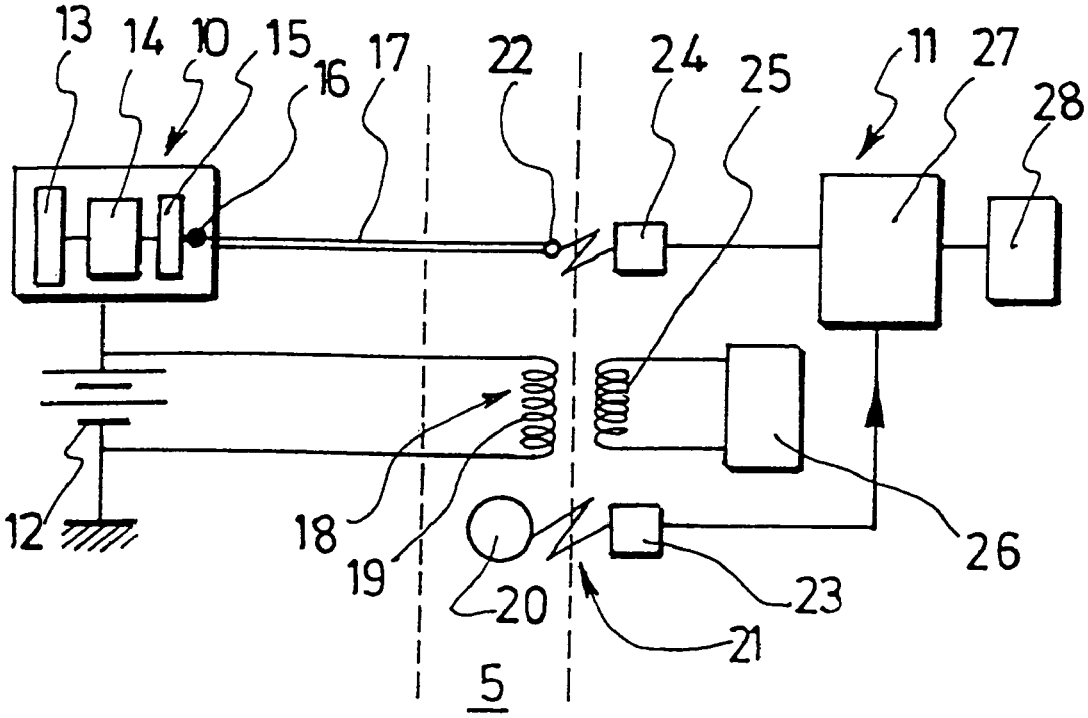
FIG. 2 is a block diagram of the functional electrical, electronic and optical means of the rocket in FIG. 1.

The inertia wheel 5, which is symbolised in FIG. 2 by the two vertical broken lines, supports the secondary winding 19 of a coupling transformer 18 to supply energy to the nose 2 of the rocket, which nose is connected to the battery 12, a wheel 20 of an optical encoder 21 and a laser diode 22, or an LED, as applicable, for transmission to the body 1 of the rocket, of the images of the device 10.

The trajectory correction equipment 11 of the body of the rocket comprises the emitter-receiver 23 of the optical encoder 21, the diode 24 for receipt of the images transmitted, the primary winding 25 of the transformer 18, with its source 26, and circuits 27 for processing of the images received and for guiding and control of the rudders 28 of the rocket, which circuits are connected to the receiver diode 24 and to the emitter-receiver 23 of the encoder 21. The circuits 27 include an on-board computer.

The encoder 21 indicates the relative angular position between the image-formation device 10 and the body 1 of the rocket. The rocket is guided by means of the circuit computer 27, according to this angular position and to the comparison between the images which are received from the image-formation device and are stabilised in the circuits 27, and the images previously stored, supplied for example by a sighting device.

The guiding commands are applied synchronously with the rocket's own rotation, taking into account also the place where the rudder is located.

Figure 5:
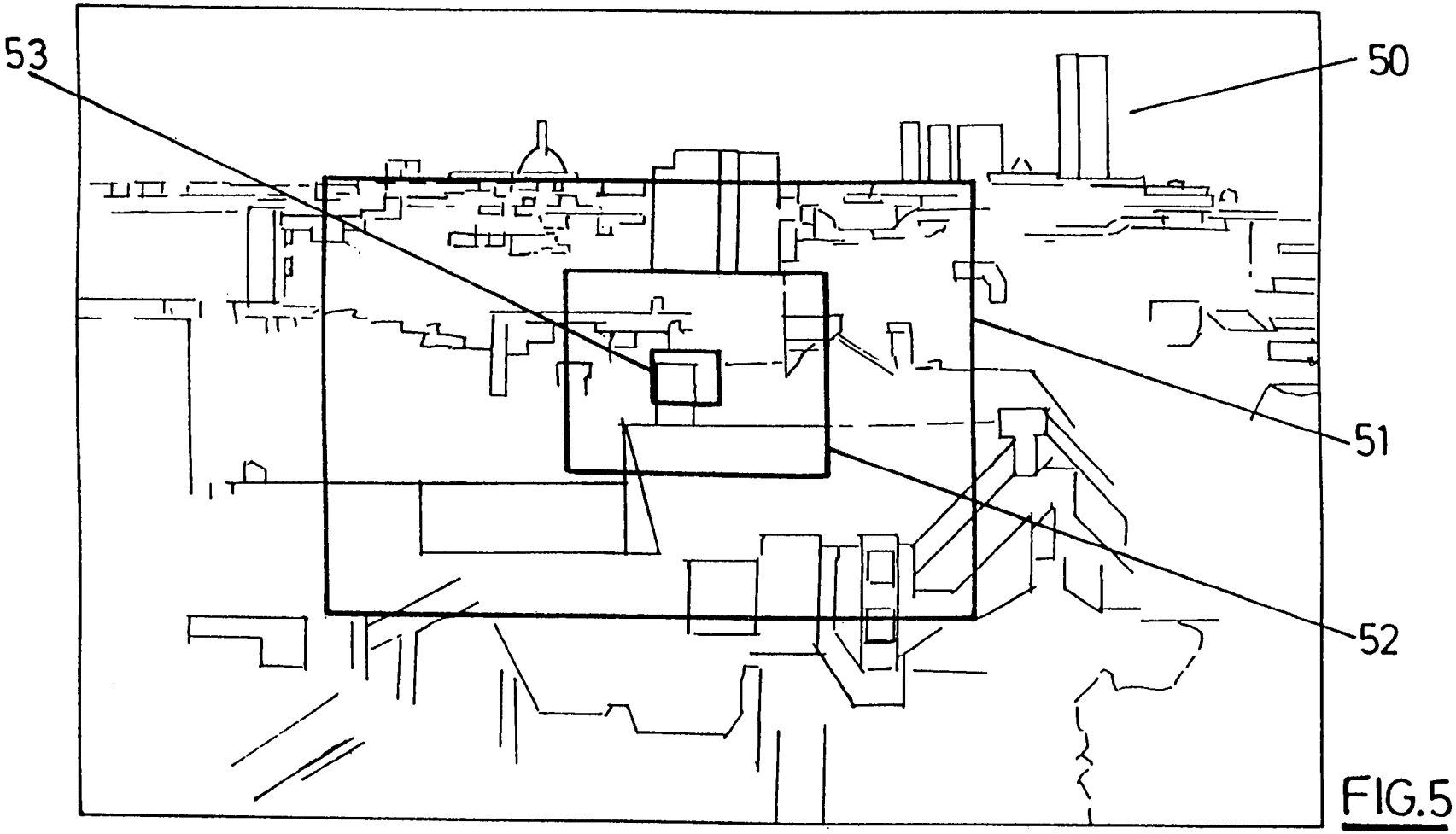
FIG. 5 is a representation of the image of the image-formation device of the rocket, showing the different fields of image pick-ups.

Before the rocket is launched, by means of a sighting device the operator takes a large field image 52 of the scene, which is stored, and which, since spatial low frequencies are involved, will be used to determine the approximate direction of the target (FIG. 5). He also takes a small field image 53 which is also stored.

With reference to FIG. 5, the overall view is a navigation field view 50, with, in its interior, a field view 51 of the self-guiding unit of the rockets, then a large field view 52, then a small field view 53 even further in the interior.

Figure 6:
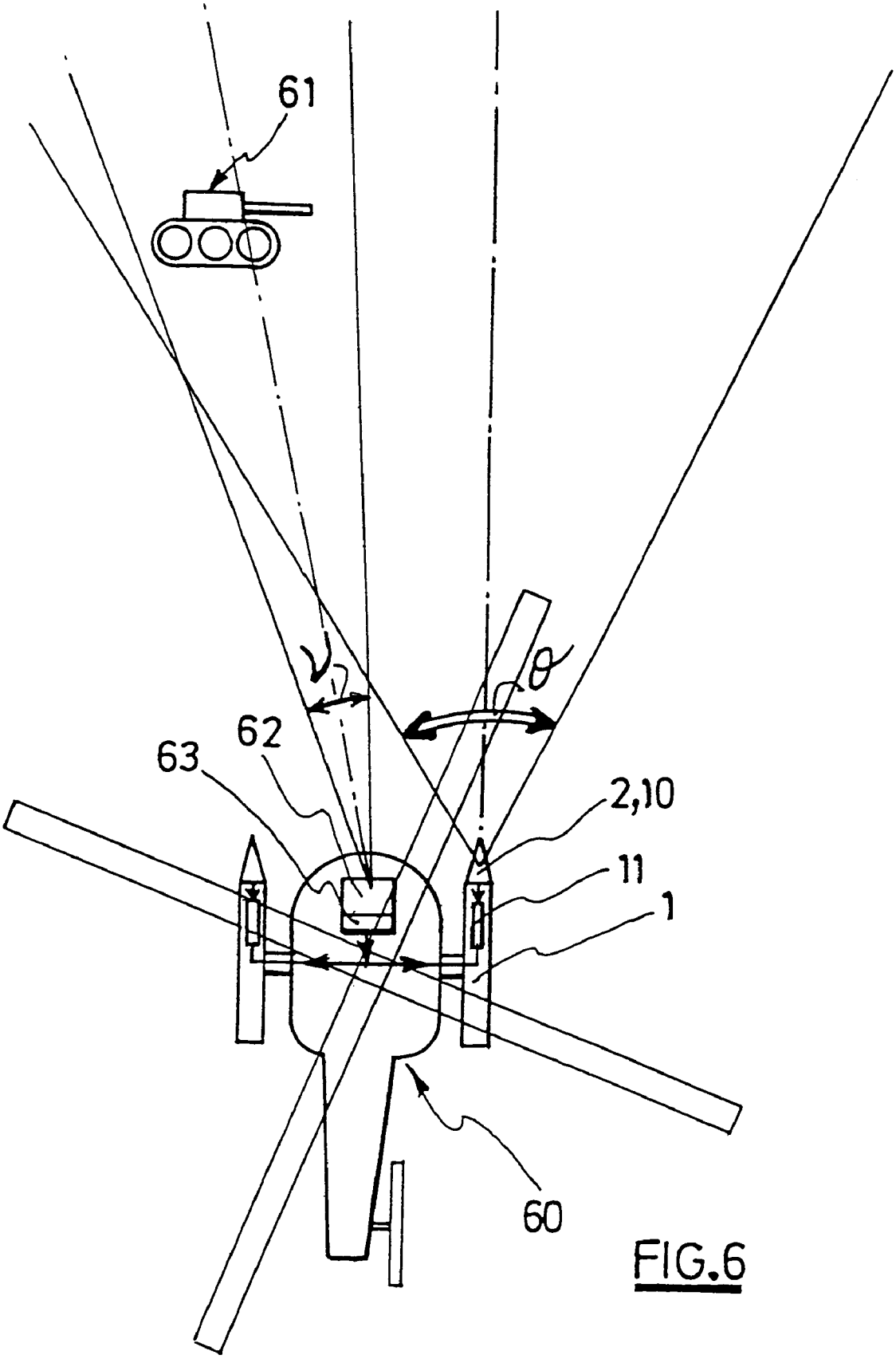
FIG. 6 is a schematic view illustrating the method for guiding a rocket to a target, from a helicopter.

FIG. 6 shows the example of an operator who is in a helicopter 60, which is equipped on each of its two sides with a rocket 1, 2 to be guided to the target to be reached, which in this case consists of a tank 61. This FIG. 6 shows a sighting device 62 and a firing computer 63 of the helicopter, as well as the field angle θ of the self-guiding unit of the right-hand rocket, corresponding to the view 51, and the small field angle ν of the sighting device 62 of the helicopter, corresponding to the view 53, in which angles the tank 61 is located.

Thus, the firing conduction operator, who fires from the helicopter 60, starts by acquiring the target 61 by means of his sighting device 62. i.e. he proceeds to determine the position, the distance and the speed of the target 61, which will enable him subsequently, in combination with a flight model and by means of the firing computer 63, to produce an initial guiding or control law. During this time, the helicopter pilot will bring the helicopter axis as closely as possible in the direction sighted by the firer, by means of a repeater.

After the target 61 has been acquired and designated by the operator, the on-board computer will proceed to bring into line the sighting device 62 and the image-formation device 10 of the rocket, and will then stabilise the images of the image-formation device of the rocket, before producing the optimal guiding law for the rocket.

For reasons which will become apparent hereinafter, the description will be provided firstly of the stage of stabilisation of the images of the image-formation device of the rocket.

Let us consider the observation and guiding camera 13 of the rocket in FIG. 1. This may be a video camera or an infra-red camera.

If the scene is stationary, the points of the scene seen by the camera between two images are connected by the trajectory of the carrier.

The Cartesian co-ordinates of the scene in the range marker of the carrier are P=(x, y, z)', the origin is the centre of gravity of the carrier, with the z axis oriented according to the main rolling axis, and the x axis corresponds to the yawing axis and the y axis corresponds to the pitching axis.

The camera is in a system of three-dimensional Cartesian or Polar co-ordinates with the origin placed on the front lens of the camera and the z axis directed along the sighting direction.

The position of the camera relative to the centre of gravity of the carrier is defined by three rotations (ab, vc, gc) and three translations (Txc, Tyc, Tzc). The ratio between the 3D co-ordinates of the camera and those of the carrier is:

$$(x',y',z')'=R(ac,bc,gc)*(x,y,z)'+T(Txc,\ Tyc,\ Tzc)$$

in which

R is a 3×3 matrix of rotation

T is a 1×3 matrix of translation.

The trajectory of the centre of gravity is characteristic of the development of the state of the system, and may be described by the differential equation system $$x(t)=F(t).x(t)+u(t)+v(t)$$

x=state vector with a dimension n

F(t)=matrix which is a function of t, with a dimension n u=input vector which is a function of a known t v=Gaussian white noise with n dimensions.

The state of the system is itself observed by means of the camera and solving of the optical flow equation, by m measurements z(t) associated with the state x by the observation equation:

$$z(t)=H(t).\ x(t)+w(t)$$

in which H(t) is a matrix m×n which is a function of t, and w is a Gaussian white noise with a dimension m, which can be assimilated to the angular and linear vibrations of the camera relative to the centre of gravity of the carrier.

The discrete model is written as:

$$x_{k+1}=F_k*x_k+u_k+v_k$$

$$z_k=H_k*x_k+w_k$$

$x_k=[aP_k, aV_k, bP_k, bV_k, gP_k, gV_k, xP_k, xV_k, yP_k, yV_k, zP_k, zV^k]^T$ is the state vector at the instant K, of the trajectory, consisting of the angles and speeds, yawing, pitching, rolling and positions and speeds at x, y and z.

$x_{k+1}$ is the state vector at the instant k+1 wherein $t_{k+1}-t_k=Ti$.

$u_k$ is the input vector which is a function of known k; it is the flight or trajectory model of the centre of gravity of the carrier.

$v_k$ is the Gaussian white noise with n dimensions, representing the acceleration noise in yawing, pitching, rolling and at positions x, y, z.

If the angles and translations to which the camera is subjected relative to the centre of gravity are not constant during the trajectory, in a sighting device for example, it is sufficient to describe their values measured or controlled (ac(t), bc(t), gc(t), Txc(t), Tyc(t), Tzc(t) according to t or k.

Since the trajectory of the centre of gravity of the carrier is defined by the vector $x_{k+1}$, the trajectory of the camera can be defined by a vector $xc_{k+1}$.

$$xc_{k+1}=R(ac,\ bc,\ gc)*(F_k*x_k+u_k+v_k)+Tc$$

Between the instants of observation k and K+1, the camera undergoes pure 3D rotations and three translations, the values of which are provided by the vector $x'_{k+1}$.

Let us consider the situation where the elements of the scene are projected on the image plane of the camera, and only these projections are known.

Figure 3:
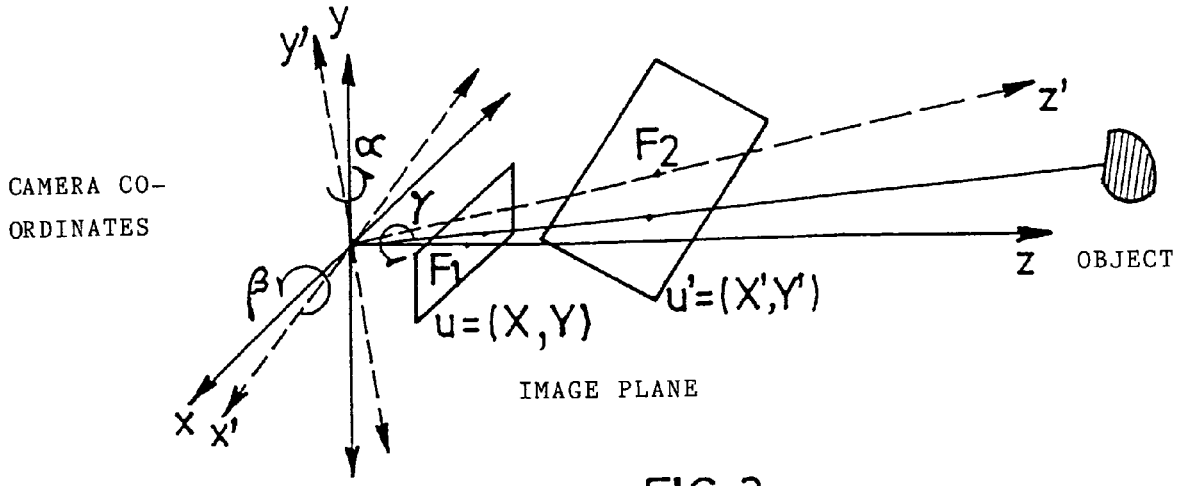
FIG. 3 illustrates the geometry of the movement of an image pick-up camera.

FIG. 3 shows the geometry of the movement of the camera in the 3D space of the real world.

The camera is in a system of three-dimensional Cartesian or Polar co-ordinates, with the origin placed on the front lens of the camera and the axis z directed along the sighting direction.

Two cases of different complexities exist:

The scene is stationary whereas the camera zooms and turns in the 3D space.

The scene is stationary whereas the camera zooms and translates in the 3D space.

Let P=(x, y, z)'=(d, a, b)' be the Cartesian or Polar camera co-ordinates of a stationary point at the time t $$x=d.\sin(a).\cos(b)$$

$$y=d.\sin(b).\cos(a)$$

$$z=d.\cos(a).\cos(b)$$

and P'=(x', y', z')'=(d', a', b')' be the camera co-ordinates corresponding to the time t'=t+Ti.

The camera co-ordinates (x, y, z)=(d, a, b) of a point in space and the co-ordinates on the image plane (X, Y) of its image are associated by a transformation of perspective which is equal to:

$$X=F1(X,Y).x/z=F1(X,Y).tg(a)$$

$$Y=F1(X,Y).y/z=F1(X,Y)/tg(b)$$

wherein F1(X,Y) is the focal length of the camera at the time t.

$$(x',y',z')'=R(da,db,dg)*(x,y,z)'+T(Tx,Ty,Tz)$$

wherein $R=R_\gamma R_\beta R_\alpha$ is a 3×3 matrix of rotation and alpha=da, beta=db, gamma=dg are, respectively, the yawing angle, the pitching angle and the rolling angle of the camera between the time t and t'

T is a 1×3 matrix of translation where Tx=x'−x, Ty=y'−y and Tz=z−z'are the translations of the camera between the time t and t'.

Since the observations by the camera are carried out at the frame frequency (Ti=20 ms), it can be noted that these angles develop little between two frames, and consequently certain calculations can be simplified.

When the focal length of the camera at the time t develops, there is:

$$F2(X,Y)=s.F1(X,Y)$$

wherein s is known as the zoom parameter, and the co-ordinates (X'Y') of the image plane can be expressed by $$X'=F2(X,Y).x'/z'=F2(X,Y).tg(a')$$

$$Y'=F2(X,Y).y'/z'=F2(X,Y).tg(b')$$

If it is wished to distinguish the deduced movements of the camera more finely from those of the carrier and the real movements of the camera, it will be said that the carrier and the camera have the same trajectory, but that the camera additionally undergoes linear and angular vibrations.

$$(x',y',z')'=R(da+aw,db+bw,dg+gw)*(x,y,z)'+T(Tx+xw,\ Ty+yw,Tz+zw)$$

wherein aw, bw, gw, xw, yw, zw are the angular vibrations.

These linear and angular vibrations can be assimilated to zero average noises, which may or may not be white according to the spectrum of the carrier concerned.

The optical flow equation is written as:

$$\text{image}_{k-1}(X,Y)=\text{image}_k(X,Y)+\frac{\partial(\text{image}_k(X,Y))}{\partial X}.dX_{k\cdot 1}(X,Y)+ =\frac{\partial(\text{image}_k(X,Y))}{\partial Y}.dY_{k-1}(X,Y)$$

wherein:

$$\text{image}k+1(Ai,Aj)=\text{image}k(Ai,Aj)+\text{Gradient}X(Ai,Aj).dAi.\text{step}H+\text{Gradient}Y(Ai,Aj).dAj.\text{step}H$$

wherein GradientX and GradientY are the derivates according to X and Y of imagek(X,Y).

In order to estimate the gradients, use is made only of the adjacent points. Since only the global movement of the image of the landscape is sought, there will be interest only in the spatial very low frequencies of the image, and thus filtering of the image accordingly. Thus, the gradients calculated are significant.

The low-pass filtering consists in a conventional manner of sliding a nucleus of convolution from pixel to pixel of the digitised images of the camera, on which nucleus the origin of the nucleus is replaced by the mean of the scales of grey of the pixels of the nucleus. The results obtained with a rectangular nucleus 7 pixels high (v) and 20 pixels wide (H)

are very satisfactory on scenes which are contrasted normally. On the other hand, if it is wished for the algorithm to function also on some isolated hot spots, it is preferable to use a nucleus which preserves the local maximum levels and does not create discontinuity in the gradients. It is also possible to use wavelet functions as an averaging nucleus.

An averaging nucleus in the form of a pyramid was therefore used (triangle according to X convoluted per triangle according to Y). The complexity of the filter is not increased, since use was made twice of a rectangular nucleus with a sliding mean of [V=4; H=10]. Wavelet functions can also be used as the averaging nucleus.

Only dX and dY are unknown, but if it is possible to break down dX and dY according to the parameters of the state vector which is of interest, and of X and Y (or Ai,Aj) such that the parameters of the state vector are then the only unknown factors, it will be possible to write the equation in a vectorial form B=A*Xtrans, wherein A and B are known.

Since each spot of the image can be the subject of the equation, there exists a over-determined system A*Xtrans=B, which it will be possible to solve by means of the least squares method.

The optical flow equation measures all the displacements of the camera. It has previously been seen that it was possible to distinguish the deduced movements of the camera more finely from those of the carrier and the real movements of the camera, by saying that the carrier and the camera have the same trajectory, but that the camera also undergoes linear and angular vibrations.

$$(x',y',z')'=R(da+aw,db+bw,dg+gw)*(x,y,z)'+T(Tx+xw,\ Ty+yw,Tz+zw)$$

wherein aw, bw, gw, xw, yw, zw are the angular and linear vibrations.

The displacements caused by the trajectory of the camera (da, db, dg, Tx, Ty, Tz) are contained in the state vector $x'_{k+1}$ of the camera, or rather in the estimation which can be produced of this, by averaging, or by having a Kalman filter which provides the best estimation.

Since the optical flow equation measures all of the displacements, it will be possible to deduce their angular and linear vibrations aw, bw, gw, xw, zw for stabilisation purposes.

It should be noted that except for extremely specific configurations, it will never be possible to see the linear vibrations, taking into account the observation distance, as well as their low amplitudes in relation to the displacements of the carrier. There will therefore be observation of: dw+aw, db+bw, dg+gw, Tx, Ty, Tz.

Let us take the optical flow equation once more:

$$\text{image}_{k-1}(X,Y)=\text{image}_k(X,Y)+\frac{\partial(\text{image}_k(X,Y))}{\partial X}\cdot dX_{k-1}(X,Y)+ = \frac{\partial(\text{image}_k(X,Y))}{\partial Y}\cdot dY_{k-1}(X,Y)$$

wherein:

$$\text{image}_{k+1}(X+dX_{k+1}(X,Y),\ Y+dY_{k+1}(X,Y))=\text{image}k(X,Y)$$

If this operation is carried out, it can be seen that the images of the sequence will be stabilised in an absolute manner. Contrary to inertia-type stabilisation where the sighting line is adversely affected by bias, drift and scale factor errors, it is possible to create representation of the scene which is not adversely affected by bias and drift if stabilisation is carried out according to three axes and if the optical distortion defects have been compensated for. The fourth axis (zoom) may not be necessary, but it is indispensable in the case of optical zoom, and also in the case when the focal distance is not known sufficiently accurately, or when the focal distance varies with the temperature (IR optics, Germanium, etc) or with the pressure (air index).

This may affect applications where it is wished to accumulate frames without streaking, or if it is wished to retain an absolute reference of the landscape (dynamic bringing into line of a self-guiding unit and a sighting device, for example).

However, it may also affect applications where it will be attempted to restore the landscape information in an optimal manner by obtaining an image which is free from sampling effects and size-detection effects.

It is possible to obtain simultaneously improvement of the spatial resolution and reduction of the temporal noise or fixed spatial noise.

It can be noted that the same equation can also be written as:

$$\text{image}_{k+1}(X,Y)=\text{image}(X-dX_{k+1}(X,Y),\ Y-dY_{k+1}(X,Y))$$

The values $dX_{k+1}(X,Y)$, $dY_{k+1}(X,Y)$ are obviously not known at the instant k. On the other hand, by using the camera movement equations they can be estimated at the instant k+1.

This provides greater reliability in measurement of the speeds, and permits high dynamics of movements.

Since the same point P of the landscape, of co-ordinates $X_k$, $Y_k$ in the image K, will be at the co-ordinates $X_{k+1}$ $Y_{k+1}$ in the image k+1, because of the three rotations a $V_{k+1}$. Ti, $bV_{k+1}$. Ti, $gV_{k+1}$. Ti, and because of the change of focal distance, it is necessary to carry out opposite zoom factors and rotations in order to stabilise the image k+1 absolutely on the image k.

Let us now examine the particular case of a stationary scene, without camera translation.

When the camera undergoes pure 3D rotations, the ratio between the 3D Cartesian camera co-ordinates before and after the movement of the camera is:

$$(x',y',z')'=R*(x,y,z)$$

wherein R is a 3×3 matrix of rotation and alpha=da, beta=db, gamma=dg are, respectively, the yawing angle, the pitching angle and the rolling angle of the camera between the time t and t'.

In 3D Polar camera co-ordinates, the ratio before and after the movement of the camera is:

$$(d',a',b')'=K(da,db,dg)*(d,a,b)'$$

Since the scene is stationary, the following is obtained:

d'=d for all the points of the landscape $$X=F1(S,Y).x/z=F1(X,Y).tg(a)$$

$$Y=F1(X,Y).y/z=F1(X,Y).tg(b)$$

When the focal length of the camera at the time t develops, the following is obtained:

$$F2(X,Y)=s.F1(X,Y)$$

where s is known as the zoom parameter, and the co-ordinates (X',Y') of the image plane can be expressed by $$X'=F2(X,Y).x'/z'=F2(X,Y).tg(a')$$

$$Y'=F2(X,Y).y'/z'=F2(X,Y).tg(b')$$

There are therefore four parameters which can vary.

Let us consider the practical case, in order to solve the optical flow equation, of estimation of the speeds of yawing, pitching and rolling and of the change of focal distance.

$$B(:,:,1)=\text{image}k+1(Ai,Aj)-\text{image}k(Ai,Aj)$$

If it is assumed that:

$$A(:,:,1)=\text{Drift}Y(Ai,Aj).(1+Aj.\text{step}V/F1(X,Y))\hat{}2)$$

$$A(:,:,2)=\text{Drift}X(Ai,Aj).(1+Ai.\text{step}H/F1(X,Y))\hat{}2)$$

$$A(:,:,3)=\text{Drift}Y(Ai,Aj).Ai.\text{step}H/\text{step}V-\text{Drift}X(Ai,Aj).Aj.\text{step}V/\text{step}H$$

$$A(:,:,4)=\text{Drift}X(Ai,Aj).Ai+\text{Drift}Y(Ai.Aj).Aj$$

$$X\text{trans}(1)=F1(0.0).bVk+1.Ti/\text{step}V$$

$$X\text{trans}(2)=F1(0.0)..aVk+1.Ti/\text{step}H$$

$$X\text{trans}(3)=gVk+1.Ti$$

$$X\text{trans}(4)=(s-1).Ti$$

it will be attempted to solve the equation:

$$A*X\text{trans}-B=0$$

The least squares method is used in order to minimise the standard.

The equation can be written for all the points of the image. However, in order to improve the precision and limit the calculations, it can be noted that in the equation A*Xtrans=B, the term B is the difference between two successive images, and all the values which are too weak or close to the noise can be eliminated.

In the tests carried out, all the points contained between +/−0.6Max(B) and +/−MaxB were retained. For the sequences studied, the number of points developed from a few tens to approximately 1500. It is also possible to take a fixed number of approximately 1000 from amongst the sequences, close to the maximum.

Figure 4:
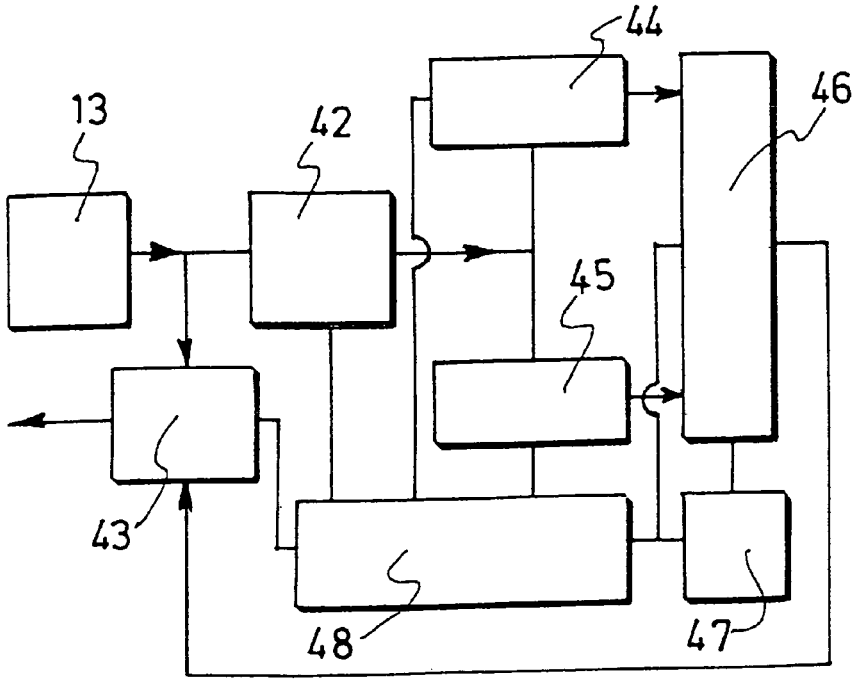
FIG. 4 is a functional diagram of the image-formation device of the rocket, which permits implementation of the electronic stabilisation of its images and bringing into line with the sighting device.

With reference to FIG. 4, a brief description will now be provided of the image-formation system which permits implementation of the stabilisation stage.

The image pick-up camera 13 conveys its image video signal to a low-pass filter 42, as well as to a processing unit 43, which receives the stabilisation data at a second input, and supplies the stabilised images as output. At its second input, the unit 43 thus receives the rotation speeds to which the images taken by the camera 13 are to be subjected. The output of the filter 42 is connected to two buffer memories 44,45, which store respectively the two filtered images of the present instant t and of the past instant t−1. The two buffer memories 44,45 are connected to two inputs of a calculation component 46, which is either an ASIC or an FPGA (field programmable gate array). The calculation component 46 is connected to a work memory 47, and at its output it is connected to a processing unit 43. All the electronic components of the system are controlled by a management micro-controller 48.

Having now described the stabilisation stage, the stage of bringing into line can be discussed.

The bringing into line implemented in the method for guiding according to the invention is an extrapolation of the stabilisation stage, the sighting device and the image-formation device of the rocket having been mounted on the same carrier before launching.

The stabilisation of the images of the image-formation device of the rocket is a self-stabilisation method, wherein the image of the instant t is stabilised on the image of the instant t−1. In other words, it can be said that each image of the image-formation system is brought into line with the previous one.

In order to bring the two devices into line, at the same instant t, the two images of the two devices are taken and are stabilised on one another, i.e. the two devices are brought into line.

Bringing into line amounts to combining the optical axes of the two devices, as well as matching in pairs the pixels of the two images, and preferably also proceeding to combine these pixels.

It will be appreciated that the two devices to be brought into line according to this method must be of the same optical nature, i.e. they must function on comparable wave lengths.

In this case, since the two devices both take images of the same scene on a land reference frame, the images of the scene taken at the same instants are filtered by the two devices in a low-pass filter, in order to retain only the spatial low frequencies, and the equation of the optical flow between these respective pairs of images of the two devices is solved, in order to determine the rotations and variation of the ratio of the respective zoom parameters to which these images must be subjected in order to bring them into line with one another.

As previously stated, the initial guiding law is developed firstly by means of the position, distance and speed of the target, and secondly by means of a flight model.

Having developed the initial guiding law of the rocket, the firing conduction operator proceeds with launching of the rocket. Up to a certain distance from the target 61, until the rocket acquires the target, the image taken by the image-formation device 10 of the rocket is compared with the large field image 52 stored of the scene, taken initially with the sighting device 62, i.e. the guiding of the rocket is controlled continuously.

After the target 61 has been acquired by the rocket, the guiding of the rocket is continued to the final phase, by comparison of the image taken by the image-formation device 10 of the rocket, with the small field image 53 which is also stored.

The invention claimed is:

1. A method for guiding a rocket to a target, the rocket equipped with automatic guiding means with an image-formation device and means for correction of the trajectory, the method comprising the steps of:

acquiring the target by a sighting device and determining its position prior to launch of the rocket;

stabilizing the images of the rocket image-formation device;

comparing images captured by the sighting device and the rocket image-formation device;

aligning the sighting device and the rocket image-formation device based upon the image comparison;

producing a guiding law;

launching the rocket; and guiding the rocket according to the produced law until the rocket itself acquires the target.

2. The method for guiding according to claim 1, wherein, before launching, an initial guiding law is produced and the rocket is guided until it acquires the target according to this initial law.

3. The method for guiding according to claim 1, wherein, before launching, an initial guiding law is produced, and after launching a continuously variable guiding law is produced for correction of the trajectory until the rocket acquires the target.

4. The method according to claim 1, wherein, in order to align the sighting device and the image-formation device of the rocket, electronic alignment is carried out according to which, on a land reference frame, filtering takes place of the images of the scene taken at the same instants by the two devices in a low-pass filter, in order to retain only the spatial low frequencies, and the equation of the optical flow between these respective pairs of images of the two devices is solved in order to determine the rotations and the variation of the ratio of the respective zoom parameters to which these images must be subjected in order to bring them into line with one another.

5. The method according to claim 1, wherein the images of the image-formation device of the rocket are stabilized in a land reference frame on the landscape.

6. The method according to claim 5, wherein, in the land reference frame, the images of the scene taken by the image-formation device are filtered in a low-pass filter, in order to select only the spatial low frequencies, and the equation of the optical flow is solved in order to determine the rotations to which the images must be subjected so as to stabilize them on the preceding images.

* * * * *